US006162082A

United States Patent [19]

Karsten et al.

[11] Patent Number: 6,162,082

[45] Date of Patent: Dec. 19, 2000

[54] SUBMERSIBLE ELECTRICAL CONNECTOR AND METHOD FOR QUICK CONNECTION AND DISCONNECTION INCLUDING TAMPER INDICATION

[75] Inventors: Lee L. Karsten, Fox Point; Michael T. Gengler, West Allis, both of Wis.

[73] Assignee: Badger Meter, Inc., Milwaukee, Wis.

[21] Appl. No.: 09/238,766

[22] Filed: Jan. 28, 1999

[51] Int. Cl.[7] ..... H01R 13/213

[52] U.S. Cl. ..... 439/318; 439/321

[58] Field of Search ..... 439/318, 312, 439/557, 313, 321

[56] References Cited

U.S. PATENT DOCUMENTS

| | | | |
|---|---|---|---|
| 3,124,405 | 3/1964 | Massa | 339/60 |
| 3,643,208 | 2/1972 | Massa, Jr. | 339/102 R |
| 3,719,918 | 3/1973 | Kerr | 339/90 R |
| 4,220,808 | 9/1980 | Fujita | 174/48 |
| 4,433,206 | 2/1984 | Lewis | 174/356 |
| 4,486,062 | 12/1984 | Kasugai | 339/91 R |
| 4,526,431 | 7/1985 | Kasukawa | 339/45 R |
| 4,629,272 | 12/1986 | Mattingly et al. | 339/90 R |
| 4,702,710 | 10/1987 | Dittman et al. | 439/271 |
| 4,762,504 | 8/1988 | Michaels et al. . | |
| 4,874,324 | 10/1989 | Andersen et al. | 439/271 |
| 5,067,909 | 11/1991 | Behning | 439/315 |
| 5,387,129 | 2/1995 | Hotea | 439/587 |
| 5,470,248 | 11/1995 | Wood | 439/281 |
| 5,564,938 | 10/1996 | Shenkal et al. | 439/301 |
| 5,567,174 | 10/1996 | Erickson, Jr. et al. | 439/462 |
| 5,580,282 | 12/1996 | Paterek | 439/685 |
| 5,662,488 | 9/1997 | Alden | 439/314 |
| 6,010,348 | 1/2000 | Alden | 439/274 |

FOREIGN PATENT DOCUMENTS 404123773 4/1992 Japan .

*Primary Examiner*—Brian Sircus
*Assistant Examiner*—Son V. Nguyen
*Attorney, Agent, or Firm*—Quarles & Brady LLP

[57] ABSTRACT

A sealed connector assembly (10) for use with equipment subject to submersion under water includes two electrical connector shells (25, 29) which are inserted in bayonet fashion into opposite sides of a locking member (40), which is then manually rotated to lock the parts together and shield the electrical connection. The three parts have alignment marks (56, 58, 59) for axial assembly and another mark (57) indicating the rotation of the locking member (40) to a locked position. A body of grease (55) is disposed in one connector shell (25) and an O-ring (50) is placed on the barrel (27) to provide sealing when the connector shells (25, 27) are locked together. The connector shells (25, 29) have wire entry ports and sealing ports for admitting an encapsulating material to seal the wire entry ends. Score lines (68, 69) allow for fracture and removal of the locking member (40) during servicing. Methods of assembly and disassembly are also disclosed.

22 Claims, 3 Drawing Sheets

FIG. 4
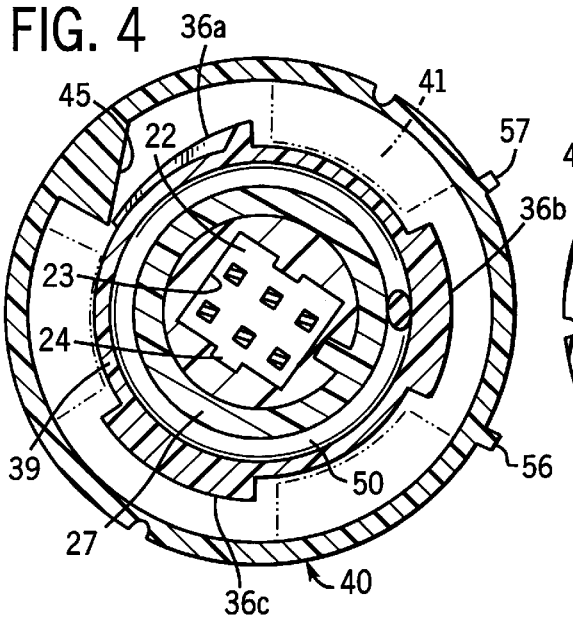
FIG. 5
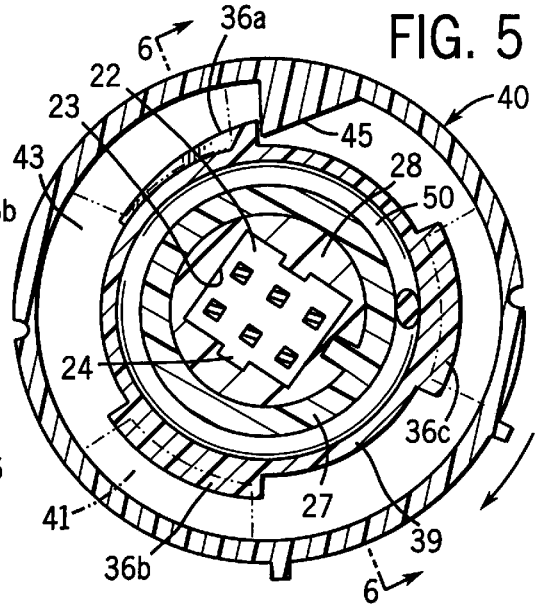
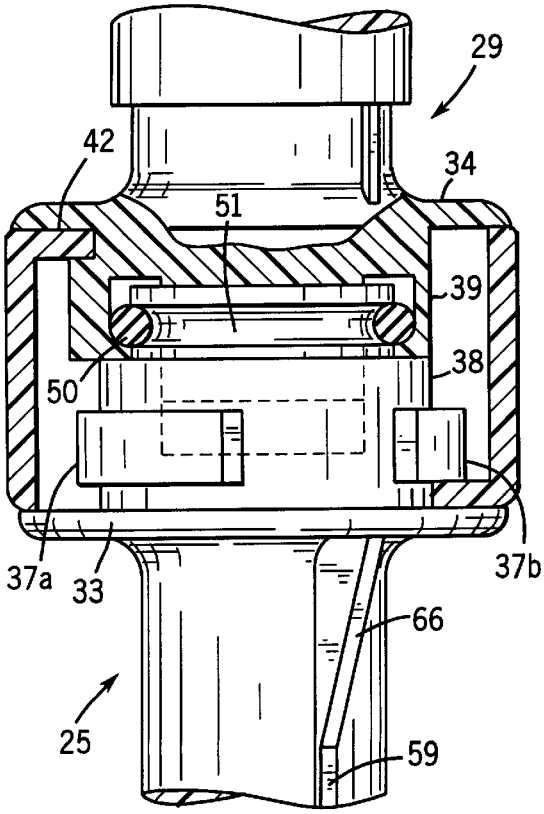
FIG. 6
FIG. 7
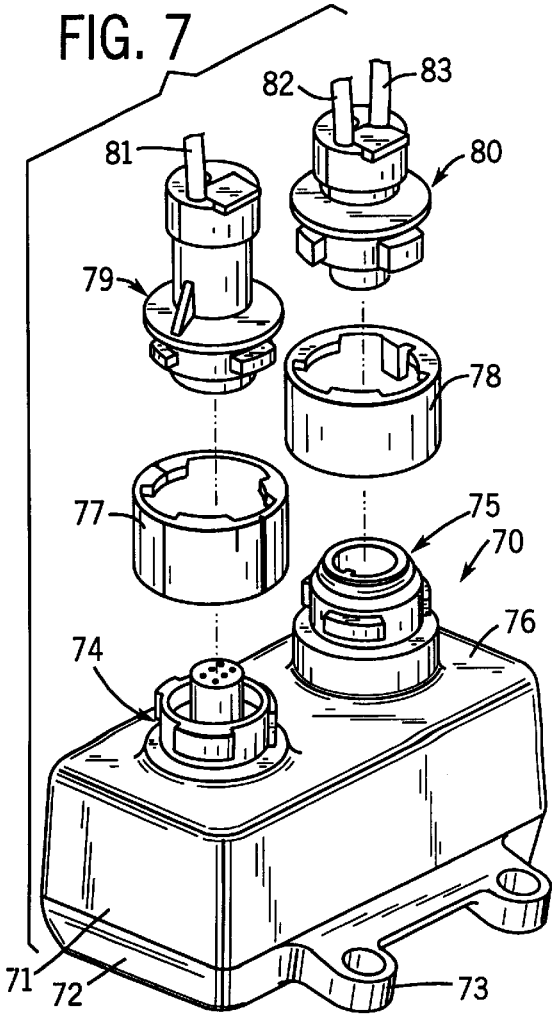

SUBMERSIBLE ELECTRICAL CONNECTOR AND METHOD FOR QUICK CONNECTION AND DISCONNECTION INCLUDING TAMPER INDICATION

TECHNICAL FIELD

The invention relates to electrical connectors that may be submersed under water and to methods for field installation and removal of electrical connectors to provide a modular system of equipment.

DESCRIPTION OF THE BACKGROUND ART

Prior art electrical connectors are shown in Alden, U.S. Pat. No. 5,662,488, issued Sep. 2, 1997; Shenkal et al., U.S. Pat. No. 5,564,938, issued Oct. 15, 1996; Behning, U.S. Pat. No. 5,067,909, issued Nov. 26, 1991; Mattingly, U.S. Pat. No. 4,629,272, issued Dec. 16, 1986; and Kasukawa, U.S. Pat. No. 4,526,431, issued Jul. 2, 1985.

Alden shows a connector assembly with three basic parts: a male connector, a female connector and a collar for connecting the two connectors. The collar of Alden uses bosses, sometimes formed on flexible fingers, for traveling in grooves to a position where they are held by frictional or snap action forces against withdrawal. Behning also shows a ring-shaped collar for coupling a male-type connector body and a female-type connector and further provides alignment marks on the three parts to assist the connection. Shenkal et al. discloses a collar that snaps over an edge that is ramped in an axial direction and also shows an opening in such a collar for the purpose of fracturing it and removing it to disassemble the connectors.

Connectors with sealing aspects are disclosed in Kerr, U.S. Pat. No. 3,719,918, issued Mar. 6, 1973; Paterek, U.S. Pat. No. 5,580,282, issued Dec. 3, 1996; Hotea, U.S. Pat. No. 5,387,129, issued Feb. 7, 1995; Kasugai, U.S. Pat. No. 4,486,062, issued Dec. 4, 1984; Andersen et al., U.S. Pat. No. 4,874,324, issued Oct. 17, 1989; Dittman et al., U.S. Pat. No. 4,702,710, issued Oct. 27, 1987; Lewis, U.S. Pat. No. 4,433,206; issued Feb. 21, 1984; Massa, Jr., U.S. Pat. No. 3,643,208, issued Feb. 15, 1972; Massa, U.S. Pat. No. 3,124,405 issued Mar. 10, 1964; and Yooku, Japanese Abstract No. JP4-123773, issued Apr. 23, 1992.

Andersen et al., U.S. Pat. No. 4,874,324 and Lewis, U.S. Pat. No. 4,433,206, disclose the use of a potting compound in an electrical connector shell for the purpose of retaining and waterproofing both the input cable and the individual wires routed to the connector pins and sockets.

Hotea, U.S. Pat. No. 5,387,129 to Hotea, and Massa, Jr. U.S. Pat. No. 3,643,208 show methods of sealing connectors with potting compound.

In Paterek, U.S. Pat. No. 5,580,282, and Kasugai, U.S. Pat. No. 4,406,062, show the use of O-rings for providing a seal between two mating cylindrical parts.

None of the above prior art shows a connector for submersible applications which provides for quick connection and locking to prevent further access except in cases of further servicing or in cases in which such access provides a tamper indication. Such a connector is desired for field installation and servicing of water metering equipment located in subsurface pits and enclosures.

SUMMARY OF THE INVENTION

The invention relates to a sealed connector assembly for use with equipment subject to submersion under water. The connector assembly has two electrical connector subassemblies, which are conveniently inserted and locked by a locking member to prevent unauthorized access. The locking member is frangible for authorized disconnection, and also to provide an indication of unauthorized disconnection or tampering.

Each connector subassembly of the present invention is sealed at a wire entry end and is double sealed at the front ends which are mated together. The first seal at the front end is provided by a body of grease contained in cavities of the connector bodies and closely surrounding the electrical connectors. The second seal at the front end is provided by an O-ring seal where the front end of one connector subassembly telescopingly slides into the front end of the other connector subassembly.

The invention further provides an improved method for assembly and in the field.

In one detailed aspect, the invention improves over prior systems in providing a frangible locking member in the form of a collar with a pair of score lines, one of which can be fractured to remove the collar, and the other which can be fractured, or which can act as a hinge to allow easier removal.

In another detailed aspect of the invention, the two connector subassemblies and the locking member have alignment marks for axial assembly and another mark indicating the rotation of the locking member to a locked position.

The invention is provided in a wire-to-wire connection embodiment and in an embodiment where two wiring subassemblies are connected to a junction box for converting signals from the equipment being connected. The configuration and operation of the two wiring subassemblies and the locking member allows a technician handle and connect the two wiring subassemblies even when working outside in cold or damp conditions. The two wiring subassemblies are further provided with features, such as radially exending flanges, which enhance the finger gripping of the wiring subassemblies and the locking member.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIG. 4 is a sectional view of the assembly in the unlocked position taken in the plane indicated by line 4-4 in FIG. 1;

FIG. 5 is a sectional view of the assembly in the locked position taken in the plane indicated by line 5-5 in FIG. 2;

FIG. 6 is a sectional view of the assembly taken in the plane indicated by line 6-6 in FIG. 5;

FIG. 7 is an exploded perspective view of a second embodiment of the invention illustrated in a vertical position;

DETAILED DESCRIPTION OF THE PREFERRED EMBODIMENTS

Figure 2:
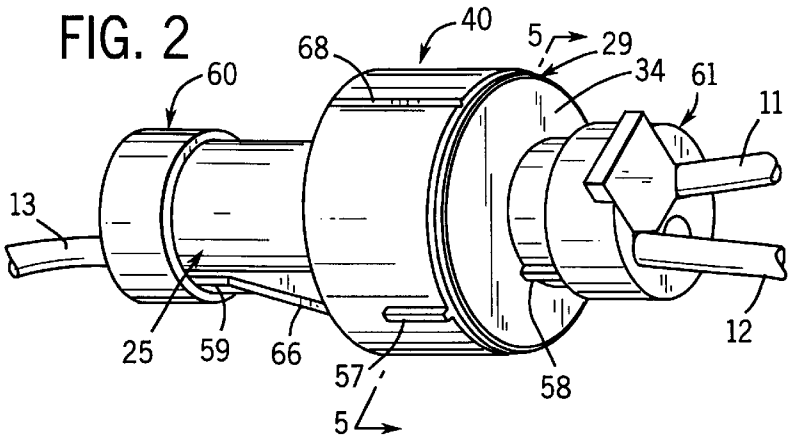
FIG. 2 of the electrical connector assembly of FIG. 1 in an assembled and locked position.

FIGS. 1–6 illustrate a first embodiment of a connector assembly 10 of the present invention for electrically connecting a pair of multi-wire cables 11, 12 on the right to another multi-wire cable 13 on the left. Each cable 11, 12 and 13 includes a plurality of wires 14 (FIG. 3) which each further includes a conductor (not visible) and an insulating covering. There is also an insulating jacket 15 around each bundle of wires 14.

Figure 3:
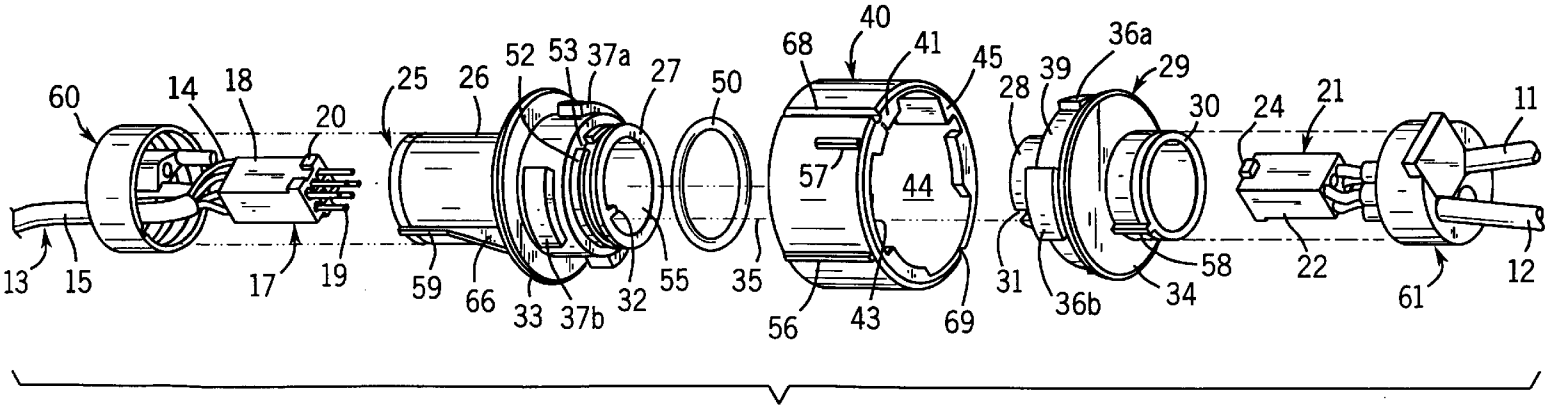
FIG. 3 is an exploded perspective view of the connector assembly of FIGS. 1 and 2.

The cables 11, 12 and 13 are connected in a pair of connector subassemblies, which are seen in FIG. 3. Each of the connector subassemblies includes a tubular connector shell 25, 29, an electrical connector 17, 21, an end cap 60, 61, and a sealant 67, which is injected into the end caps 60, 61 to seal the back ends of the connector subassemblies.

As further seen in FIG. 3, the female connector shell 25 has a stem 26 in which the electrical connector 17 is inserted. The connector 17 is connected to the wires in cable 13. The connector 17 has a body 18, gold-plated conductor pins 19, and keys 20 on the body 18 for orienting and holding the body 18 in position in the stem 26 of a female connector shell 25. Alternatively, the connector 17 could be a male coaxial-type connector. The stem 26, which extends towards the rear end of shell 25 has a cylindrical exterior shape, but forms a passageway of generally rectilinear cross section (like 23 in FIGS. 4 and 5) with reciprocally keyed portions for mating with the keys 20 on the body 18. In the female connector shell 25, there is a forwardly extending barrel 27 and the connector 17 is in a recessed position in the barrel 27 to prevent exposure of the pins 19.

Still referring to FIG. 3, a male connector shell 29 receives an electrical socket connector 21 of a generally known type. Alternatively, the connector 21 could be a female coaxial-type connector. The connector 21 is connected to the wires 14 in the other two cables 11, 12. The connector 21 has a body 22, has a plurality of sockets in which gold-plated electrical contacts are situated and has keys 24 on the body 22 for orienting and holding the body 22 in the barrel 28 of the male connector shell 29. The barrel 28 is formed with a cylindrical exterior shape, but also has a central passageway 23 of generally rectilinear cross section (FIGS. 5 and 6) with reciprocally keyed portions for mating with the keys 24 on the body 22. The barrel 28 has an external key recess 31 (FIG. 3) which mates with a key 32 in the form of a projection in the barrel 27 of the female connector shell 25. This orients the two parts in a rotational direction. Referring to FIG. 3, the barrel 28 is oriented relative to the key 32 and is then inserted axially into the barrel 27 of the female connector shell 25 where the pins 19 of connector 17 are inserted into the sockets of connector 21. The barrel 28 has an outer diameter which is smaller than the inner diameter of the barrel 27, such that the barrel 27 receives the barrel 28 of a male connector shell 29 in telescoping fashion. The barrel 27, in turn, is received in telescoping fashion within a cylindrical flange 39 (see FIG. 6) which encircles both barrels 27, 28 and abuts axially extending section 38.

Referring again to FIG. 3, each connector shell 25, 29 has a respective radially extending flange 33, 34 which provides a surface for finger pressure when the connector shells 25, 29 are being pushed together along a central axis 35. Gussets 66 are provided on the female connector shell 25 to assist gripping the connector shells 25, 29, during an assembly operation to be described below.

The male connector shell 29 has three radially extending tooth-like projections 36*a*, 36*b* and 36*c* formed on a cylindrical flange 39 of greater diameter than barrel 28. The projections 36*a*, 36*b* and 36*c* are preferably three in number, are arcuate in shape and are spaced apart around the circumference of the flange 39.

The female connector shell 25 also has three radially extending tooth-like projections 37*a*, 37*b* and 37*c* formed on a thickened axial section 38 of its barrel 27. The projections 37*a*, 37*b* and 37*c* are preferably three in number, are arcuate in shape and are spaced apart around the circumference of the barrel 27.

The male connector shell 29 and the female connector shell 25 are integrally formed parts which are molded of a plastic material.

The tooth-like projections 36*a*–36*c* and 37*a*–37*c* allow for a bayonet-type connection to be explained further below. The shells 25, 29 are inserted into, and secured by, a locking member 40, which could be characterized as a locknut, a locking collar or a locking ring.

The locking member 40 is more particular formed as a ring-shaped band having a notched flange 41 around a rim and around an opening 44 through the middle of the member 40. There is also a notched flange 42 (not seen in FIG. 3, but seen in section in FIG. 6) on the oppositely facing side of the member 40 from flange 41. The notches 43 (see FIG. 3) in the flanges 41, 42 are spaced apart around their circumference and are configured to receive the tooth-like projections of the connector shells 25, 29 between radially inwardly directed portions of the flanges 41, 42. The reciprocal configuration of the tooth-like projections and the flanges 41, 42, properly orients the shells 25, 29, when they are inserted axially into the central opening 44 in the member 40.

For locking purposes, the locking member 40 forms a ramp member 45 (FIGS. 3, 4 and 5) which is tapered in a circumferential direction around the inside of the member 40. One of the teeth 36*a* on the male connector shell 29 has a curved, tapered profile in the circumferential direction (see FIGS. 4 and 5). This allows the tooth 36*a*, first, to slide axially by the ramp member 45 and flange 41 during axial insertion (see FIG. 4), and second, when the member 40 is rotated counterclockwise (as viewed in FIGS. 1–3), to slide in the direction of rotation over the ramp member 45. The ramp member 45 acts as a pawl or catch until the curved tooth 36*a* reaches a non-reversible locked position on the thick end of the ramp member 45 (FIG. 5).

An O-ring sealing member 50 (FIG. 3) of elastomeric or other stretchable material is seated in a groove 51 (FIG. 6) on the barrel 27 of the female connector shell 25 and is supported on one side by a segmented ring 52 (FIG. 3) formed on the barrel 27. Gaps 53 are provided in the ring 52. When the connector shells 25, 29 are assembled (FIG. 6), the O-ring 50, which is first seated in a groove 51, is further received in the flange 39 of the male connector shell 29. The O-ring 50 provides a seal where the shells connect 25, 29. The shells 25, 29 and the locking member 40 are made of a water impervious plastic material and are molded as integral components.

Referring again to FIG. 3, the interior of the barrel 27 of the female connector shell 25 is filled with a grease 55 to encapsulate and provide a first layer of protection for the conductive parts of the electrical connectors 17, 21. A suitable grease for electrical connections is provided by Nyogel 760-G available from Nye Lubricants, Bedford, MA. This is placed in the female connector shell 25 at the factory, and held in place by a temporary cap. In the field, the cap can be removed to allow the connector shells 25, 29 to be connected together.

Figure 1:
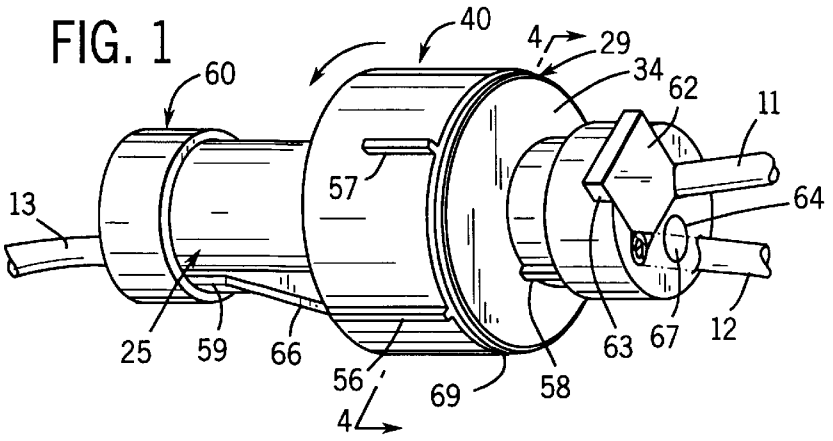
FIG. 1 is a perspective view of an electrical connector assembly of the present invention in an assembled but unlocked position.

To seal the ends of the connector assembly 10, a pair of end caps 60, 61 are provided as seen in FIGS. 1–3. The end caps 60, 61 each have a tab 62 (FIG. 1) which is connected by an integrally formed hinge 63 (FIG. 1) to their bodies. The end caps 60, 61 each have a hole 64 (FIG. 1) for injection of a sealant material 67. The tab 62 has recesses 65 (one of which is illustrated in FIG. 1) in the corners of its free end. Such recesses 65 form part of the holes in end caps 60, 61 for receiving the cables 11, 12 and 13.

The connector shells 25, 29 have alignment marks 56, 57, 58, 59, seen in FIGS. 1–3, for assisting the assembly of one connector subassembly 17, 25, 60 (FIG. 3) and the other connector subassembly 21, 29, 61 (FIG. 3). The locking member 40 has two ridges 56, 57 (FIGS. 1–3) extending axially on its exterior. One is a long ridge 56 extending the full axial length of the member 40 and the other is a short ridge 57 (FIGS. 1–3) extending approximately half the length of the member 40. The short ridge 57 is spaced apart by a selected rotational angle, which is this embodiment is selected as approximately sixty degrees (60°). This corresponds to the rotational distance which the securing member is rotated between the assembled position (FIGS. 1 and 4) and the locked position (FIGS. 2 and 5). Thus, the long ridge 56 is an alignment mark for the assembled position, while the short ridge 57 is used to mark the locked position. The male connector shell 29 has an axially extending ridge 58 formed on its stem 30 behind the radially extending flange 34. The female connector shell 25 has an axially extending ridge 59 and gusset 66 formed on its stem 26 and behind the radially extending flange 33. These ridges 58, 59 or marks are located for alignment with the long ridge 56 on the locking member 40 when the connector shells 25, 29 are axially inserted into the locking member 40.

The locking member 40 also has two axially extending score lines 68, 69 spaced one hundred and eighty angular degrees (180°) apart. These score lines 68, 69 are provided for insertion of a tool in one score line 68 to fracture the securing ring. The other score line 69 acts as a hinge, or it can also be fractured. The number and angular position of the alignment marks and the score lines could be varied to different numbers and angular positions in other embodiments.

The above described connector assembly 10 is utilized in methods for servicing equipment in the field as follows. A technician will initially install the connector to electrically connect equipment in underground pits or enclosures. Earlier, at a manufacturing site, the end caps 60, 61 are pushed onto the ends of the connector shells 25, 29 with the hinged tabs 62 in an open position. The electrical connectors 17, 21 are inserted into the connector shells 25, 29 and the wires extend through the rear ends of end caps 60, 61 with the hinged tabs 62 in their open position. The hinged tabs 62 will then be closed to hold the cables 11, 12 and 13 in place. A sealant material 67 is injected into the end caps 60, 61 to fill in the region in and around the cables 11, 12 and 13. This provides an electrical connector in each connector shell having the wire entry end sealed. The cable and connector parts can then be taken to the field.

In the field, a male connector shell 29 is inserted in one end of the locking member 45 and a female connector shell 25 with an O-ring 50 in place is readied for insertion on an opposite side of the locking member 40. The temporary cap or seal which encloses the body of grease 55 in a cavity formed by barrel 27 of the female connector shell 25 is removed prior to this assembly. The two connector shells are then telescopingly assembled with the pins 19 of the electrical connector 17 being inserted into the sockets in electrical connector 21 (FIGS. 4, 5 and 6) to mate with contacts therein, while the junction between connectors 17, 21 is surrounded by the body of grease 55. The assembly will then be in the position of FIGS. 1 and 4 with alignment of long mark 56 with the marks 58, 59 on the connector shells 25, 29. The locking member 40 is then rotated sixty degrees until the short mark 57 becomes aligned with the marks 58, 59 on the connector shells 25, 27. When that occurs, the tooth 36*a* with the curved tapered profile slides on, over and past the tooth or catch 45 on the inside of the locking member 40 and the assembly will be irreversibly locked to prevent access to the mated electrical connectors 17, 21. The only way to disassemble or unlock the assembly is to fracture one or more of the parts. In this case, the assembly is intended to be disassembled by fracturing locking member 40 along one of the score lines 68, 69 by insertion of part of a tool, such as a knife blade or screwdriver tip, and twisting of the tool. The locking member 40 is then fractured and removed. Once removed, the pin-type electrical connector 17 can be unplugged from the socket-type connector 21 and the shells 25, 29 can be separated. In the event that a technician observes that the locking member 40 has been fractured before being serviced by the technician, this is an indication of tampering with the connector assembly.

To reconnect one of the old connectors or to reconnect one of the old connectors with a new connector, the technician supplies a new, identical locking member 40, and connects two connectors as described previously for initial installation. In this way, the invention provides a sealed connection with ease of servicing in the field to disconnect and reconnect equipment and at the same time providing a tamper indication.

FIG. 7 shows a second embodiment of the invention. While the first embodiment provides a wire-to-wire assembly, the embodiment of FIG. 7 provides two connections to a junction box enclosure 70. Such a unit is used to signals from certain types of metering equipment and perform a ratio conversion such as 1:10 or 1:100 before the signals are transmitted to readout devices. The junction box 70 has a body 71 and lid 72 with apertured tabs 73 for mounting the junction box enclosure 70. The body 71 has two connector shells 74, 75, corresponding to female and male connector shells, 25, 29, which are integrally formed in one wall 76. One shell 74 is the male connector shell while the other shell 75 is the female connector shell. This provides a way of keying the two connections to corresponding cables and connectors for two other units of equipment, so that the connections will not be inadvertently reversed during installation.

The assembly in FIG. 7 further includes a pair of locking rings 77, 78, which are similar to locking ring 40, except that one must be flipped over for installation. The assembly in FIG. 7 further includes a pair of connector subassemblies, one having a female connector shell 79 for connection to male connector shell 74, and the other having a male connector shell 80 for connection to female connector 75. The female connector shell 77 connects to one cable 81, while the male connector shell connects to two cables 82, 83.

Figure 8:
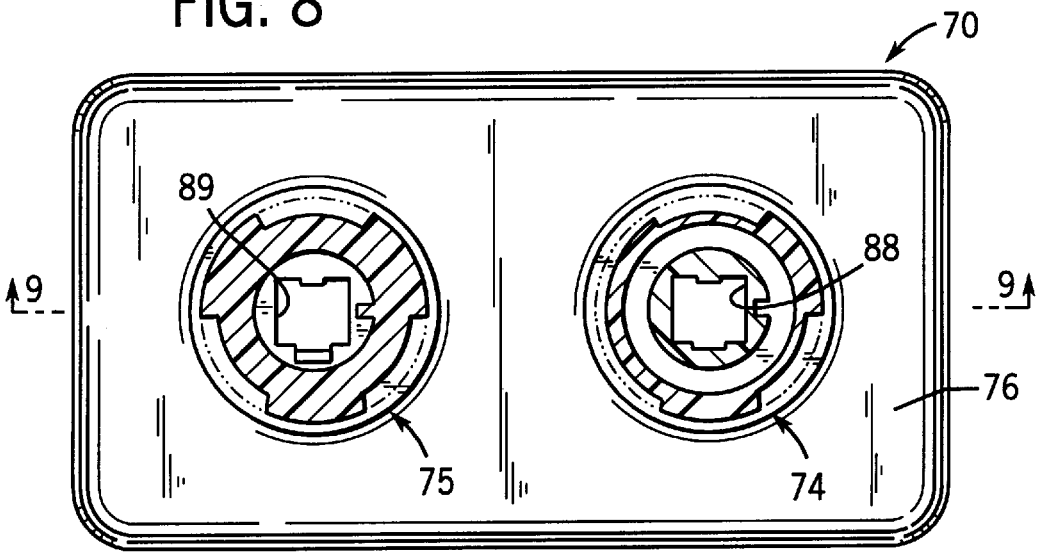
FIG. 8 is a transverse sectional view of two connector shells on the embodiment of FIG. 7.
Figure 9:
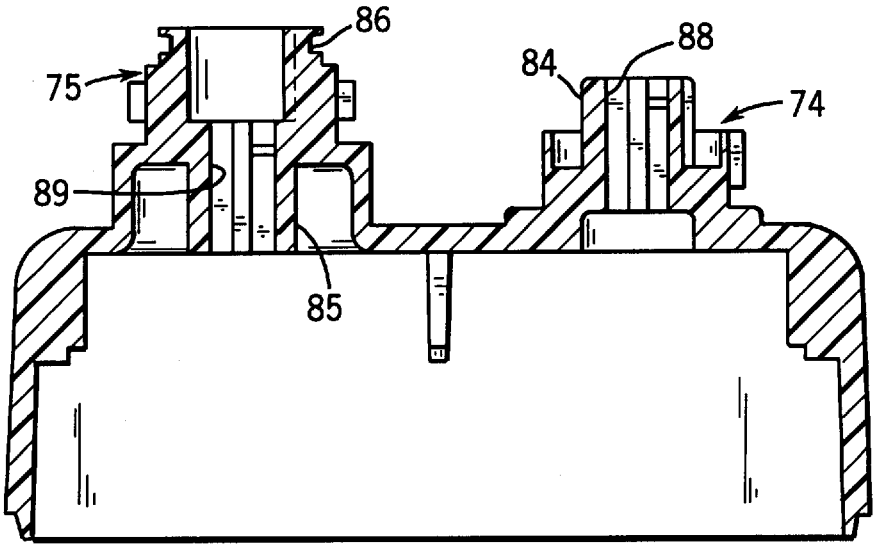
FIG. 9 is a sectional view taken in the plane indicated by line 9-9 in FIG. 8.

Referring to FIGS. 8 and 9, it can be seen how the male shell 74 includes a stem 84 with a keyed passage 88 for receiving the body 22 and keys 24 of the socket-type connector 21. The female shell 75 has a keyed passage 89 for receiving the body 18 and keys 20 of the pin-type connector 17. Note that the stem 84 resembles stem 85 extending in an opposite direction for female shell 75. Also seen in FIG. 8 is a cross section of a groove 86 for receiving an O-ring similar to O-ring 50 in FIG. 3. End caps 90, 91 are seen on the connector shells 79, 80, but are not used inside the junction box enclosure 70. Nevertheless, it is considered that the back end of each connector 74, 75 in the interior of the junction box is sealed from the environment by its sealed enclosure in junction box 70. From the description of the second embodiment, it can be seen that the connector shells 25, 29 of FIGS. 1–6 can be integrally formed with a wall 76 of a junction box enclosure 70 or can be formed as free-standing connector shells 25, 29.

This has been a description of the preferred embodiments of the method and apparatus of the present invention. Those of ordinary skill in this art will recognize that modifications might be made while still coming within the spirit and scope of the invention and, therefore, to define the embodiments of the invention, the following claims are made.

We claim:

1. A sealed electrical connector assembly for submersible applications, the connector assembly comprising:

first and second tubular connector shells having sealed wire entry ends, having telescoping barrel portions and carrying axially mating electrical contacts;

a locking ring encircling the telescoping barrel portions and movable on the first and second tubular connector shells between a first rotational position and a second rotational position;

wherein said first and second tubular connector shells have at least three radially outwardly directed projections reciprocally configured with at least three radially inwardly directed projections of said locking ring to provide for a keyed axial insertion and rotation of said first and second tubular connector shells in relation to said locking ring;

wherein the locking ring forms a tooth projecting radially inward; and wherein one of the radially outwardly directed projections on one of said first and second tubular connector shells has a tapering profile in a rotational direction, such that when said one of the radially outwardly directed projection slides over and past said tooth upon rotation of said one of said first and second tubular connector shells relative to the locking ring, said rotation becomes irreversible and the locking ring prevents manual disassembly of said first and second tubular connector shells.

2. The connector assembly of claim 1, wherein the first and second tubular connector shells and the locking ring form three alignment marks, a first alignment mark on each connector shell and a first alignment mark on the locking ring, and wherein when said three first alignment marks are rotationally aligned, first and second tubular connector shells and the locking ring can be assembled in an axial direction.

3. The connector assembly of claim 2, wherein the locking ring forms a second alignment mark spaced a rotational distance from said first alignment mark on the locking ring, such that when the second alignment mark is rotated to alignment with the first alignment marks on each connector shell, the locking ring is moved to a locked position for the connector assembly.

4. The connector assembly of claim 1, wherein the locking ring forms at least one axially extending score line along which said locking ring is susceptible to fracture with a hand tool for authorized removal, said score line being observable to indicate attempted unauthorized removal.

5. The connector assembly of claim 1, wherein the locking ring forms at least a second axially extending score line spaced an angular distance from said first axially extending score line to allow flexing of two portions of the locking ring and facilitating authorized removal.

6. The connector assembly of claim 1, wherein one of the connector shells is integrally formed in a wall of a box enclosure.

7. The connector assembly of claim 1, further comprising an O-ring encircling one of said telescoping barrel portions for sealing a connection between said first and second tubular connector shells.

8. The connector assembly of claim 7, further comprising a body of grease disposed in one barrel of one of said telescoping barrel portions for sealing a region around said mating electrical contacts.

9. A sealed electrical connector assembly for submersible applications, the connector assembly comprising:

a first subassembly having an electrical connector and having a wire entry end sealed against moisture penetration;

a second subassembly having an electrical connector and having a wire entry end sealed against moisture penetration;

wherein said first subassembly and said second subassembly each have an outwardly extending flange and each have a hollow body extending along a central axis and forward of said flange, each subassembly having a plurality of extending projections spaced around a respective hollow body, and each subassembly having a groove disposed between said projections and said outwardly extending flange;

a locking member having an opening along a central axis and having rim flanges on oppositely facing sides for receiving and holding the projections on the hollow body of each subassembly as each subassembly is axially inserted into the opening, with said rim flanges being received in respective transverse passageways in said first subassembly and said second subassembly; and wherein when said first subassembly and said second subassembly are connected within said locking member, the outwardly extending flange of each subassembly and the locking member forming an enclosure for a region of connection between the subassemblies which is shielded from access; and wherein said locking member has a non-reversing catch such that when a projection on one of the subassemblies having a tapered profile in a rotational direction slides over and past said catch upon rotation of said one of the subassemblies relative to the locking member, said rotation becomes irreversible and the locking member prevents manual disassembly of said first said first subassembly and said second subassembly.

10. The connector assembly of claim 9, wherein the first subassembly, the second subassembly and the locking member form three alignment marks, a first alignment mark on each subassembly and a first alignment mark on the locking member, and wherein when said three first alignment marks are rotationally aligned, the first subassembly, the second subassembly and the locking member can be assembled in an axial direction.

11. The connector assembly of claim 10, wherein the locking member forms a second alignment mark spaced a rotational distance from said first alignment mark on the locking member, such that when the second alignment mark is rotated to alignment with the first alignment marks on each subassembly, the locking member is moved to a locked position for the connector assembly.

12. The connector assembly of claim 9, wherein the locking member forms at least one axially extending score line along which said locking member is susceptible to fracture with a hand tool for authorized removal, said score line being observable to indicate attempted unauthorized removal.

13. The connector assembly of claim 12, wherein the locking member forms at least a second axially extending score line spaced an angular distance from said first axially extending score line to allow flexing of two portions of the locking member and facilitating authorized removal.

14. The connector assembly of claim 9, wherein one of the connector subassemblies has a portion that is integrally formed in a wall of a box enclosure.

15. The connector assembly of claim 14, wherein at least one of the subassemblies has a shell and an end cap covering one end of the shell, the end cap having at least one wire entry port and at least one sealant entry port, and wherein said end cap and a region interior of wire entry is filled with a sealing material to seal the wire entry end of said one of the subassemblies.

16. The connector assembly of claim 9, wherein the first subassembly and the second subassembly each have a shell with an end cap covering one end of the shell, the end cap having at least one wire entry port and at least one sealant entry port, and wherein a region interior of the wire entry port is filled with a sealing material to seal the wire entry end of each of the first subassembly and the second subassembly.

17. The connector assembly of claim 9, wherein each said end cap includes a body and a tab with an integral hinge to the body, the tab being movable between an open position and a closed position in which it clamps one or more wires in position.

18. The connector assembly of claim 9, wherein the hollow body of said first subassembly is received inside the hollow body of said second subassembly, and further comprising an O-ring encircling the hollow body of one of the first subassembly and the second subassembly and a cavity formed by another one of the first subassembly and the second subassembly for receiving said O-ring.

19. The connector assembly of claim 18, further including a body of grease disposed in the hollow body of one of the first subassembly and the second subassembly for sealing a region around an electrical connection of the two subassemblies.

20. A method of assembling an electrical connector assembly having a first electrical connector subassembly, a second electrical connector subassembly, and a locking member, the method comprising:

inserting the first electrical connector subassembly into one side of an opening disposed along a central axis of the locking member, while aligning a first mark on the first connector assembly to a first mark on the locking member which aligns a plurality of reciprocally arranged projections and notches on the first electrical connector subassembly and the locking member so as to permit axial insertion;

inserting the second electrical connector subassembly into an opposite side of the opening in the locking member, while aligning a first mark on the second connector assembly to the first mark on the locking member which aligns a plurality of reciprocally arranged projections and notches on the second electrical connector subassembly and the locking member so as to permit axial insertion into the locking ring where an electrical connection is made with the first electrical connector subassembly; and moving the locking member in a rotational direction to align a second mark on the locking member with the first mark on the first connector assembly and the first mark on the second connector assembly such that a projection with a tapered profile in a rotational direction slides over a catch to a non-reversible position to lock the connector assembly together.

21. The method of claim 20, further comprising, before the inserting steps, placing a body of grease in a cavity around an electrical connector in one of the first electrical connector subassembly and the second electrical connector subassembly so as to cover a region of an electrical connection between the first electrical connector subassembly and the second electrical connector subassembly when connected within the locking ring.

22. The method of claim 21, further comprising, before the inserting steps, placing an O-ring in position on a barrel of one of the first electrical connector subassembly and the second electrical connector subassembly for sealing an interengagement of the first electrical connector subassembly and the second electrical connector subassembly.

* * * * *